US005329886A

United States Patent [19]

Sylvester et al.

[11] Patent Number: 5,329,886

[45] Date of Patent: Jul. 19, 1994

[54] STEAM GENERATOR

[75] Inventors: Robert L. Sylvester; Randall C. Johnson; Gregory V. Smith; King W. Chan; Willis B. Middlebrooks, III; Jawahar K. Visaria, all of Pensacola; Robert M. Wilson, Cantonment; George Bieberbach, Pensacola, all of Fla.

[73] Assignee: Westinghouse Electric Corporation, Pittsburgh, Pa.

[21] Appl. No.: 100,845

[22] Filed: Aug. 2, 1993

[51] Int. Cl.[5] ..... F22B 1/02

[52] U.S. Cl. ..... 122/32; 122/34; 122/451 R; 122/438

[58] Field of Search ..... 122/32, 34, 428, 438, 122/451 R

[56] References Cited

U.S. PATENT DOCUMENTS

| | | | |
|---|---|---|---|
| 3,916,844 | 11/1975 | Cassell | 122/32 |
| 4,734,972 | 4/1988 | Hawkins | 29/426.4 |
| 4,899,436 | 2/1990 | Jacquier | 29/727 |
| 5,083,529 | 1/1992 | Sundheimer | 122/32 |

*Primary Examiner*—Edward G. Favors

[57] ABSTRACT

This patent discloses a secondary fluid supply system for a steam generator used in nuclear reactor power plants. The secondary fluid supply system comprises a secondary fluid (feedwater) inlet nozzle near the base of the steam generator shell, a feedwater riser pipe spaced between the shell of the steam generator and the tube bundle wrapper, the upper end of the feedwater riser pipe being connected to a distribution ring having a plurality of spray nozzles positioned in the recirculating pool above the top of the U-shaped heat exchanger tubes.

4 Claims, 4 Drawing Sheets

STEAM GENERATOR

BACKGROUND OF THE INVENTION

This invention relates to steam generators used in nuclear reactor power plants. It relates particularly to the means used to introduce the feedwater into the steam generator.

Steam generators used in nuclear reactor power plants are very large heat exchangers where heat from a primary fluid heated by the nuclear reactor is transferred to a secondary fluid (water) which is converted into steam and used to drive a turbine generator. Steam generators are housed inside a tall, generally cylindrical steel shell. A large number of U-shaped heat exchanger tubes are enclosed in the shell and have their ends inserted in holes formed in a horizontal tube sheet or plate near the bottom of the steel shell. The tubes are used to convey the primary fluid which has been heated in the nuclear reactor. The secondary fluid or feedwater used to generate the steam is introduced into steam generator in such a manner that the secondary fluid flows around the outside of the heated tubes thereby converting much of the secondary fluid into steam which is allowed to exit the steam generator through an outlet nozzle at the top of the steel shell.

Many early model steam generators (often called preheat SGs or SGS with economizers) were designed to introduce the secondary fluid or feedwater through a feedwater inlet nozzle positioned near the bottom of the steam generator where it was introduced directly to the tube bundle. The incoming secondary fluid then rose upwardly around the tubes where it was heated and converted into steam. The secondary fluid that was not yet converted into steam was captured by the moisture separators and redirected into the steam generator recirculating pool. Recirculating water from this pool flowed down between the tube bundle wrapper and the inside wall of the steel shell to the bottom of the steam generator where it was directed back into the tube bundle where it then was mixed with additional incoming secondary fluid or feedwater.

Other designs of steam generators (often called feedring SGs or non-preheat SGs) have been designed with the feedwater inlet nozzle positioned in the upper part of the steam generator to introduce the secondary fluid or feedwater into the recirculation pool where it mixes with the recirculating water before flowing down between the tube bundle wrapper and the inside wall of the steel shell to the bottom of the steam generator where it is directed back into the tube bundle and then flows upwardly around the heated tubes.

Nuclear power plants that wish to convert from the style of steam generator having a bottom secondary fluid or feedwater inlet flow introduced directly to the tube bundles (preheat SGs) to the design of steam generator having the secondary fluid or feedwater inlet at the top (feedring SGs) have had to incur great expense and difficulty to convert all the power plant secondary fluid piping, pumping, and control systems to accommodate the design change of steam generator.

SUMMARY OF THE INVENTION

It is therefore an object of this invention to provide a new design of a steam generator which can be easily installed in nuclear power plants that have previously used the older design of steam generator where the secondary fluid was introduced through an inlet nozzle located near the bottom of the steam generator.

It is a further object of this invention to provide a steam generator in which the secondary fluid is introduced into the steam generator through an inlet nozzle near the bottom of the steam generator but discharges the secondary fluid into the steam generator recirculating pool at the top of the steam generator.

Other and further objects of this invention will become apparent from the following description and the accompanying drawings and claims.

It has been discovered that the foregoing objects can be attained by a steam generator in which the secondary fluid supply system comprises a secondary fluid inlet nozzle positioned in the steam generator near the base thereof and connected to a riser pipe spaced between the inside surface of the steel shell of the steam generator and the tube bundle wrapper and connected to a distribution ring positioned horizontally in the recirculating pool at the top of the steam generator. The distribution ring has a plurality of spray nozzles adapted to introduce the secondary fluid into the steam generator recirculating pool.

DESCRIPTION OF PREFERRED EMBODIMENT

Figure 1:
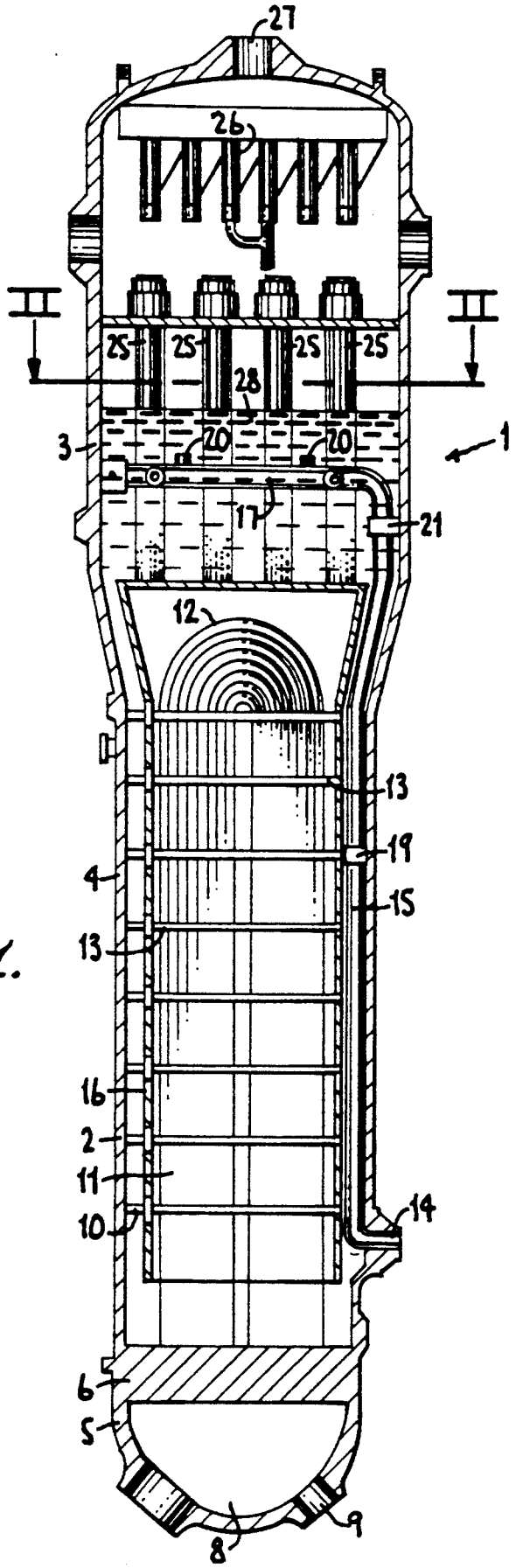
FIG. 1 is a general arrangement sectional view of a steam generator of this invention.

FIG. 1 illustrates a preferred embodiment of the steam generator of this invention. The steam generator 1 comprises a steel shell 2 of generally cylindrical shape having an enlarged upper steam section 3, a middle section 4 and a lower channel head section 5. A horizontal circular tube sheet or plate 6 is attached to the steel shell 2 and separates the lower channel head section 5 from the middle section 4. A vertical dividing plate 7 in the channel head section 5 is attached at its top to the tube sheet 6 and at its bottom to the channel head 5 and serves to divide the channel head section 5 into a primary fluid inlet plenum 8 and a primary fluid outlet plenum (not shown). A pair of manholes 9 provide access to the channel head section 5, as required.

The cylindrical middle section 4 of the steam generator 1 contains large numbers of U-shaped heat exchanger tubes 11 which are assembled into a tube bundle 12 and attached at their ends to openings in the tube sheet 6. A plurality of vertically spaced support plates or baffles 13 have openings therein similar to those in the tube sheet 6 to hold the tubes in a proper vertical alignment. Larger openings are also provided in the support plates or baffles 13 to allow the secondary fluid and the steam to flow upward through the tube bundle 12 of the steam generator 1.

According to this invention, secondary fluid or feedwater is introduced into a feedwater inlet nozzle 14 located in the lower portion of the middle section 4 of the steel shell 2 above the tube sheet 6. Feedwater inlet nozzle 14 is connected to a feedwater riser pipe 15 positioned between the inside surface of the steel shell 2 and the outside a cylindrical tube bundle wrapper 16 that is spaced inwardly from the inside surface of the steel shell 2 by spacers 10. Feedwater riser pipe 15 extends up the length of the middle section 4 and into the enlarged upper steam section 3 where it is connected to a circular feedwater distribution ring 17 provided with a plurality of spray nozzles 20, as shown in FIG. 2, which spray the secondary fluid or feedwater into the recirculating pool 28.

Figure 2:
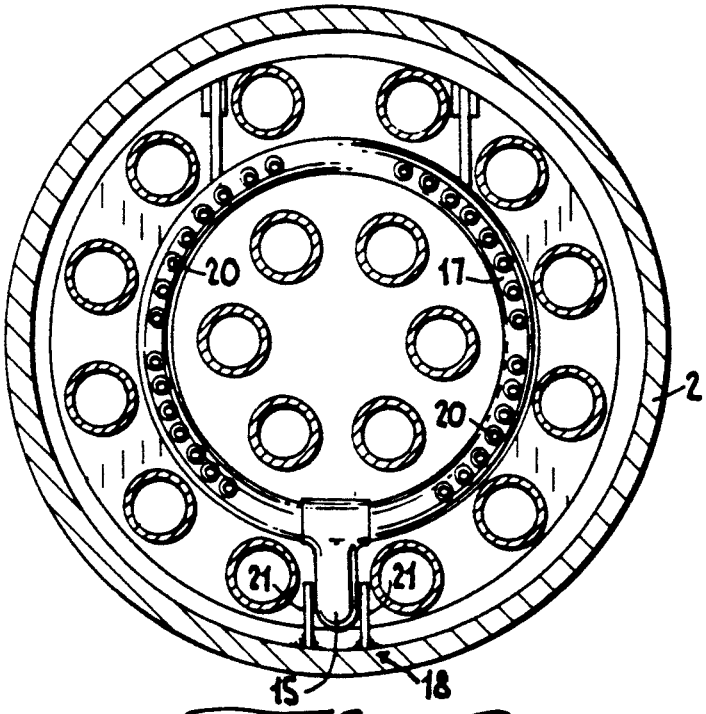
FIG. 2 is a top sectional view taken along sectional lines II—II of FIG. 1.
Figure 3:
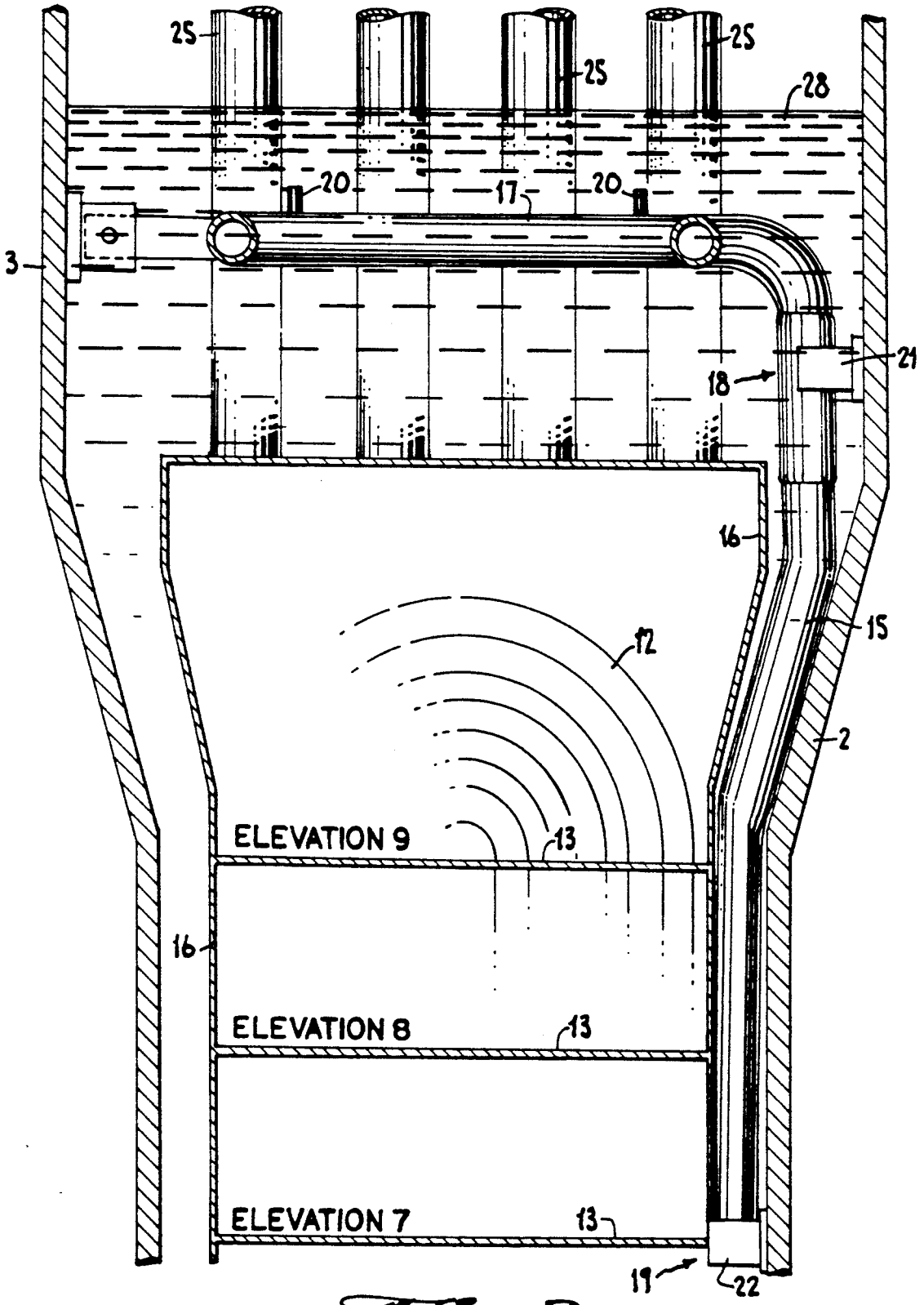
FIG. 3 is an enlarged fragmentary sectional view of the upper portion of the steam generator of this invention.
Figure 4:
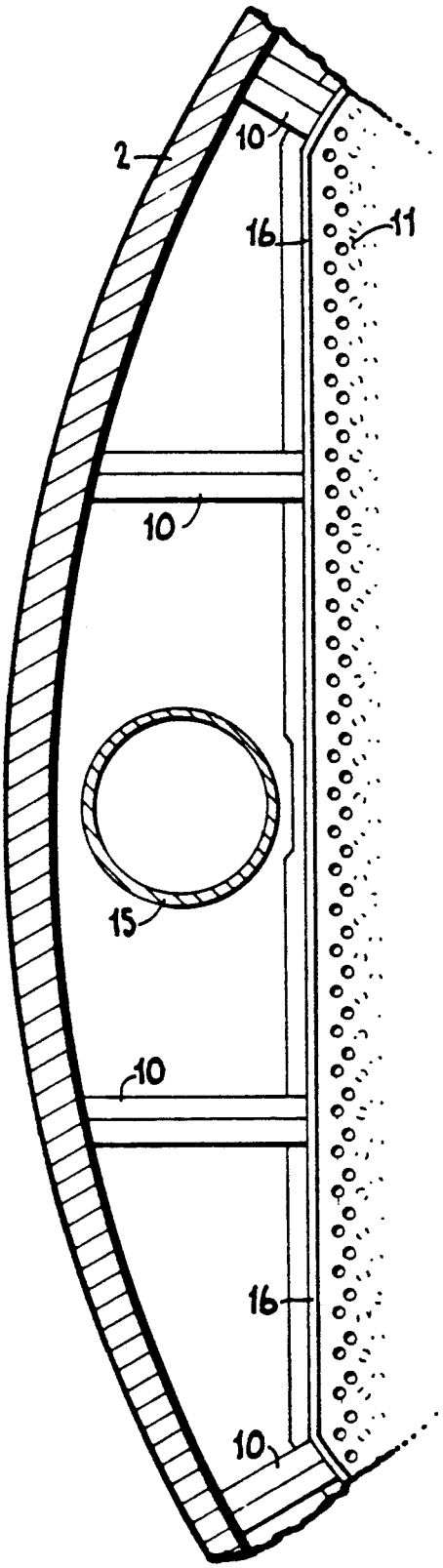
FIG. 4 is an enlarged fragmentary sectional view of a portion of the steam generator of this invention at Elevation 9 shown in FIG. 3, and also illustrating one form of modifying the tube bundle wrapper and tube arrangement to accommodate the feedwater riser pipe.
Figure 5:
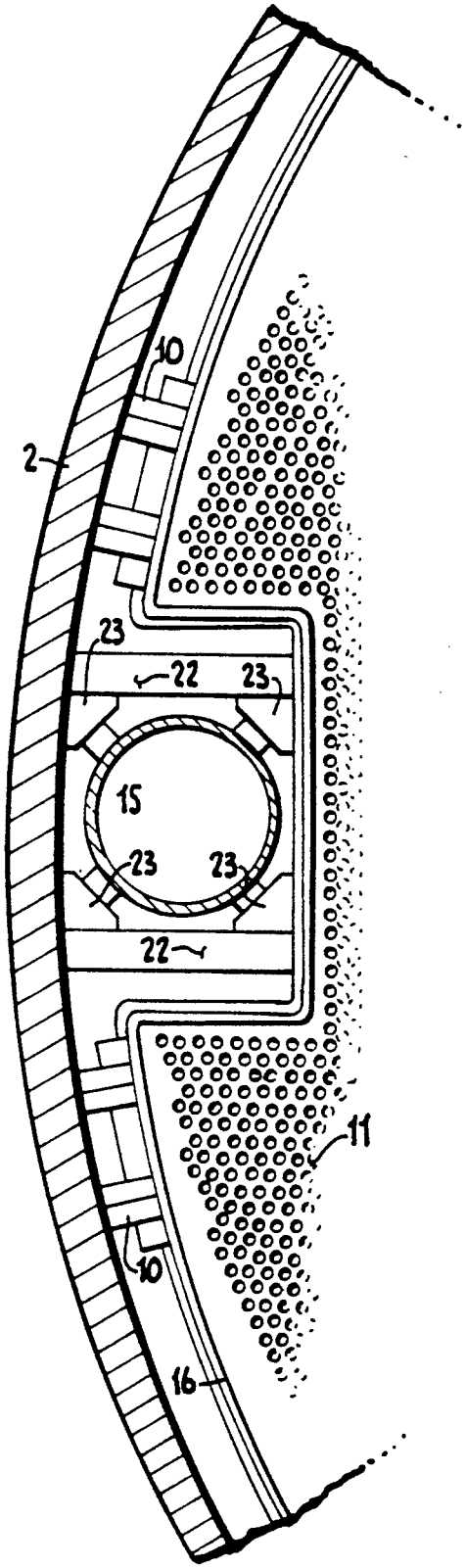
FIG. 5 is an enlarged fragmentary top sectional view of a portion of the steam generator of this invention at Elevation 7 shown in FIG. 3, and also illustrating another form of modifying the tube bundle wrapper and tube arrangement to accommodate the feedwater riser pipe.

As best shown in FIGS. 2–5, an upper lateral support means 18 and a lower lateral support means 19 are used to provide lateral support to the feedwater riser pipe 15 and resist lateral movement in feedwater riser pipe 15 caused by the flow of the secondary fluid or thermal stresses. As shown in FIG. 2, the upper lateral support means 18 is comprised of a pair of parallel plates 21 secured to the inside surface of the steel shell 2 and positioned on both sides of the feedwater riser pipe 15. The lower lateral support means 19 is shown in FIG. 5 and comprises a pair of parallel plates 22, each of which is equipped with a pair of wedge shaped pads 23 which surround the feedwater riser pipe 15. As illustrated in FIGS. 4 and 5, the tube wrapper 16 is recessed and a number of the tubes 11 in the vicinity of the feedwater riser pipe 15 are removed to accommodate the feedwater riser pipe 15 and its lateral supports. FIGS. 4 and 5 are used to illustrate two different arrangements that may be used to provide sufficient space for the feedwater riser pipe 15 in existing steam generators.

As shown in FIG. 1, the enlarged upper steam section 3 of the steam generator 1 of this invention is provided with a plurality of primary steam separators 25 and secondary steam separators 26 used to collect the steam before it is conveyed out of the steam generator 1 through the steam flow outlet nozzle 27 to the turbine generators.

By introducing the feedwater in the recirculating pool 28, the cold incoming feedwater is allowed to mix with the hot recirculating water and greatly reduces the thermal shock on the system and it components.

While what has been described is the preferred embodiment of the secondary or feedwater supply system of this invention, it is to be understood that variations of this system may be made and are within the contemplated scope of this invention.

We claim:

1. In a steam generator comprised of a generally cylindrical steel shell containing a plurality of U-shaped heat exchanger tubes connected to a heated primary fluid inlet and outlet in the base of the steel shell and having a steam outlet at the top of the steel shell, the improvement being a secondary fluid supply system comprising a secondary fluid inlet nozzle in said steel shell near the base thereof and connected to a riser pipe spaced between the inside surface of said steel shell and a cylindrical tube bundle wrapper and connected to a distribution ring positioned in an upper recirculating pool above the tops of the U-shaped heat exchanger tubes, said distribution ring having a plurality of spray nozzles adapted to introduce the secondary fluid into the recirculating pool.

2. The secondary fluid supply system of claim 1 in which said riser pipe is restrained laterally by one or more lateral support means secured to the inside surface of the steel shell.

3. The secondary fluid supply system of claim 2 in which the lateral support means comprises parallel plates on either side of said riser pipe and provided with wedge shaped bearing pads.

4. The secondary fluid supply system of claim 1 in which a steel wrapper is positioned between the riser pipe and the U-shaped heat exchanger tubes.

* * * * *